United States Patent [19]

Funkhouser

[11] Patent Number: 4,910,986

[45] Date of Patent: Mar. 27, 1990

[54] BICYCLE WHEEL RIM STRAIGHTENER STAND

[76] Inventor: William E. Funkhouser, 306 S. Santa Ana, Modesto, Calif. 95354

[21] Appl. No.: 322,204

[22] Filed: Mar. 10, 1989

[51] Int. Cl.[4] ..... B21D 3/16; B21D 53/26; B21C 51/00

[52] U.S. Cl. ..... 72/34; 72/389; 72/316; 29/802; 33/203; 248/163.1

[58] Field of Search ..... 72/316, 295, 389, 390, 72/33, 34; 29/159.1, 159.01, 802; 269/909; 33/203, 203.12; 248/163.1; 211/24, 22

[56] References Cited

U.S. PATENT DOCUMENTS

| | | | |
|---|---|---|---|
| 852,829 | 5/1907 | Einfeldt | 72/34 |
| 1,489,151 | 4/1924 | Prossen | 72/316 |
| 1,606,489 | 11/1926 | Winter | 72/390 |
| 1,650,216 | 11/1927 | Ingham | 72/316 |
| 1,786,847 | 12/1930 | Hunt | 72/316 |
| 1,955,358 | 4/1934 | Connor | 72/389 |
| 2,036,113 | 3/1936 | Befera | 248/163.1 |
| 3,636,614 | 1/1972 | Damman et al. | 29/802 |
| 3,879,027 | 4/1975 | Thurmond | 269/157 |
| 4,000,639 | 1/1977 | Postema | 72/390 |
| 4,126,942 | 11/1978 | Damman | 33/203.12 |

FOREIGN PATENT DOCUMENTS

| | | | |
|---|---|---|---|
| 492815 | 2/1930 | Fed. Rep. of Germany | 33/203 |

*Primary Examiner*—Daniel C. Crane

[57] ABSTRACT

A bicycle wheel rim straightener is provided in a single stand. Clamping devices for straightening the wheels in vertical and horizontal positions can be activated by foot and hand levers. The stand also serve as a single work station for spoke replacement and for general bicycle wheel repairs.

5 Claims, 6 Drawing Sheets

BICYCLE WHEEL RIM STRAIGHTENER STAND

BACKGROUND OF THE INVENTION

1. Field of the invention:

This invention relates to devices with built-in and attachable fixtures useful as tools for straightenting bent bicycle wheel rims. The present invention is particularly directed towards devices with the capacity to repair every kind of bend which might occur to the wheel.

2. Description of the Past Art:

A search was conducted to examine past art patents in the field. The search was made in the following classes and sub-classes.

211/20, 22, 24, and 269/158, 159

Those patents which seemed most pertinent to my device are the following U.S. Patents:

U.S. Pat. Nos. 1,063,379, 1,087,846, 1,418,924, 1,556,638, and 3,608,885 teach stands and benches that have foot activated clamps to hold work steady.

U.S. Pat. No. 4,252,304 teaches a workbench made by Black and Decker which includes various gripping methods.

U.S. Pat. No. 2,944,811 teaches a bicycle repair stand which is representative of what is left in the art.

The principal fault found in devices of the past art and with stands available on the market today is a complex approach to wheel repair requirement. Having a rim straightener on one stand, a wheel straightening and spoke replacement station on another, and the hub adjustment equipment on still a third stand requires a lot of room and many tools to repair one wheel.

SUMMARY OF THE INVENTION

Therefore, in practicing my invention, I have combined equipment for straightening bicycle wheels on a single stand. Clamping devices for straightening the wheels in vertical and horizontal positions can be activate by foot and hand levers. My stand can also serve as a single work station for spoke replacement and for general bicycle wheel repairs.

A principal object, then, of my invention is to provide a multi-tool bicycle wheel straightening facility on one stand as a complete single work station.

A another object of the invention is to provide foot levering pressure to a clamp for straightening the rim of a bicycle wheel with the wheel laid flat on a work table and the operator's hands free.

A further object of my invention is to provide a single work station where a bicycle wheel can be worked on horizontally for wheel straightening and spoke replacement and the bicycle wheel can be checked and the rim aligned vertically in a spin position.

A still further object of the invention is to provide a stand as a single work station with the stand having attachable structures allowing immediate access to replacement parts and tool.

Other objects and new features of the invention will become better understood by reading the specifications and comparing described numbered parts with the like numbered parts illustrated in the accompanying drawings.

DESCRIPTION OF THE PREFERRED EMBODIMENT

Figure 1:
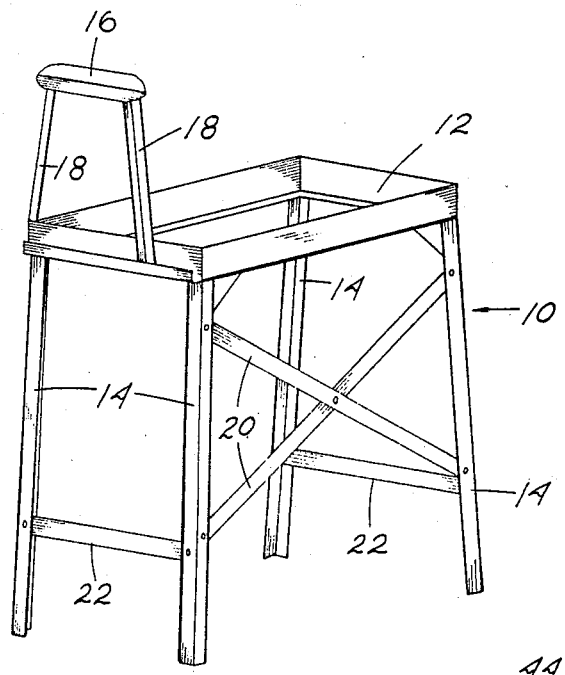
FIG. 1 is a perspective view of the stand showing the opened front and a raised pedestal at one end for supporting rim alignment fixtures.
Figure 2:
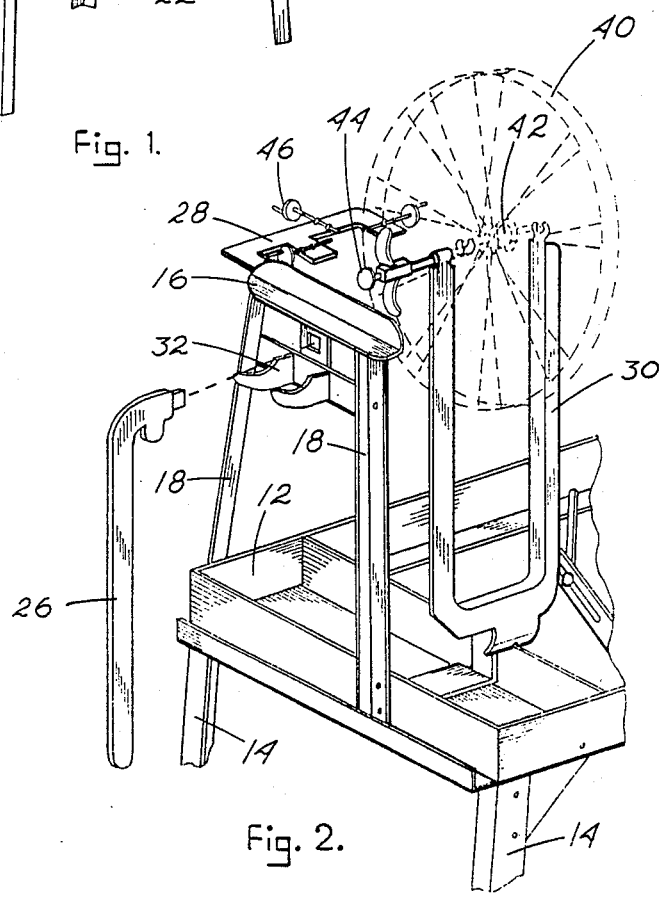
FIG. 2 is an enlargement of the raised pedestal illustrating the attachment of the alignment fixtures and showing a bicycle wheel in dotted lines positioned for rim alignment.
Figure 3:
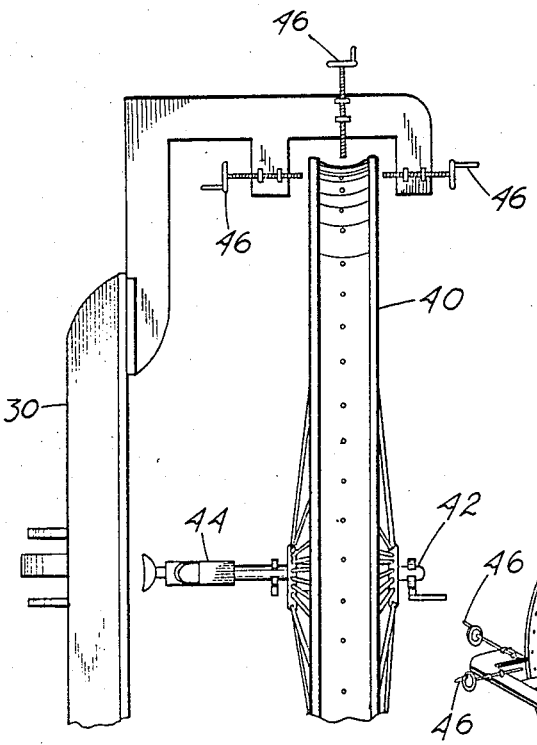
FIG. 3 is a partial top view of a vertically positioned bicycle wheel attached by sprocket to the alignment structure with the rim alignment monitor screws ready to check rim straightness.
Figure 4:
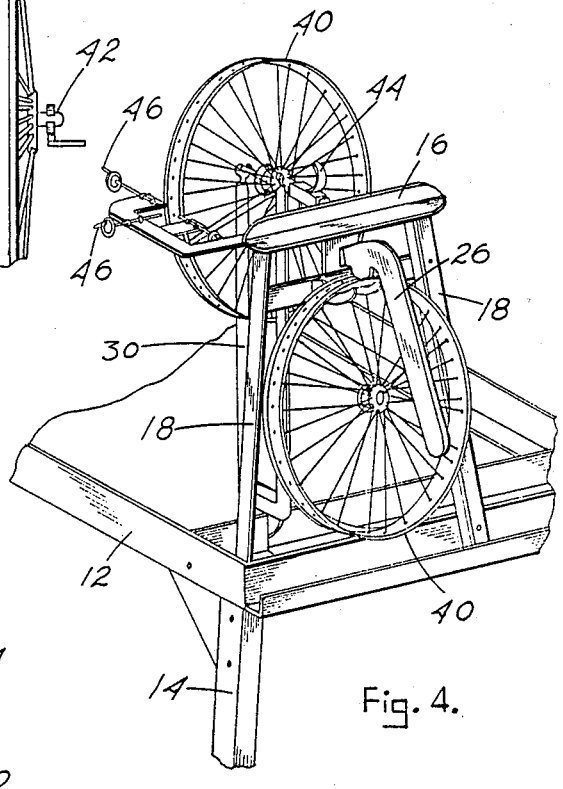
FIG. 4 shows the pedestal in a perspective view angled somewhat towards the front of the stand with one wheel in the rim alignment position and a second wheel downwardly in position for straightening the rim by a rim gauge lever. The wheels are vertically positioned.
Figure 8:
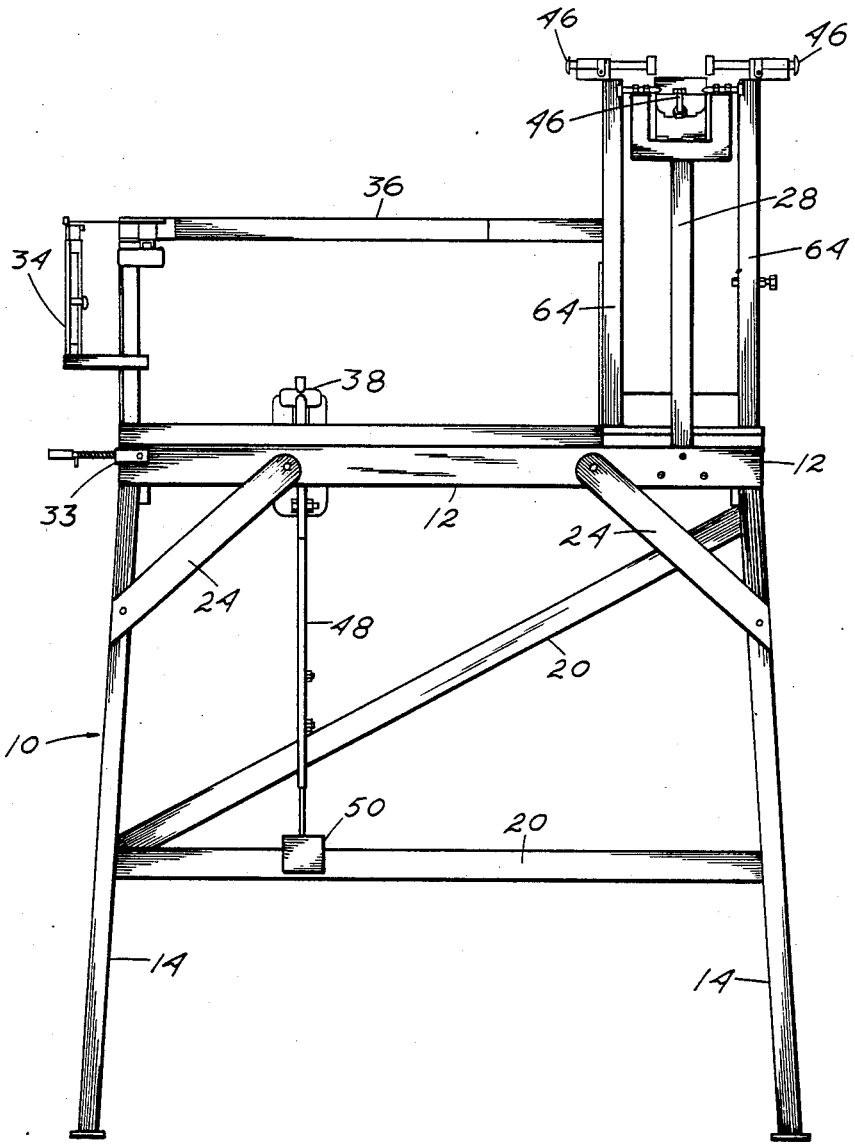
FIG. 8 is a frontal view of the completely assembled stand.

Referring now to the drawings where the invention is illustrated in a variety of full and partial views. In FIG. 1, stand 10 is structured around a table top box frame 12 and four outwardly inclined legs 14. Stand 10 is an open frame with cross side braces 22 at the ends and back brace 20 angled at the back. Back brace 20 can be a single brace as illustrated in FIG. 8 or a X brace as shown in FIG. 1. In a first embodiment, pedestal 16 with pedestal supports 18 is affixed at the end of table top box frame 12 to support wheel holder 30 and wheel alignment gauge 28. Pedestal 16 is also useful for attachment of arms 32 operational for supporting wheel 40 with lever 26 engaging wheel 40 as shown in FIG. 4. In this embodiment, shown in FIGS. 2, 3, and 4, adjustable rim aligners 46 are being used to check the straightness of vertically positioned wheel 40. In FIG. 4, the use of both arms 32, lever 26 and wheel alignment gauge 28 on wheels 40 at the same time are illustrated. FIG. 3 is a top view of wheel holder 30 holding wheel 40 on sprocket 42 by easy sprocket release 44 with adjustable rim aligners 46 being used to gauge the straightness of wheel 40.

Figure 5:
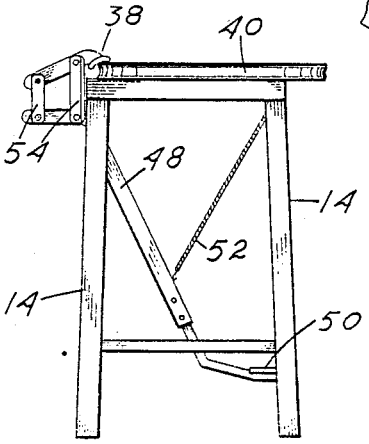
FIG. 5 shows the stand in a side view opposite the pedestal end with the pedestal removed and the foot operated pressure wheel straightening lever illustrated. A bicycle wheel is shown horizontally positioned.
Figure 6:
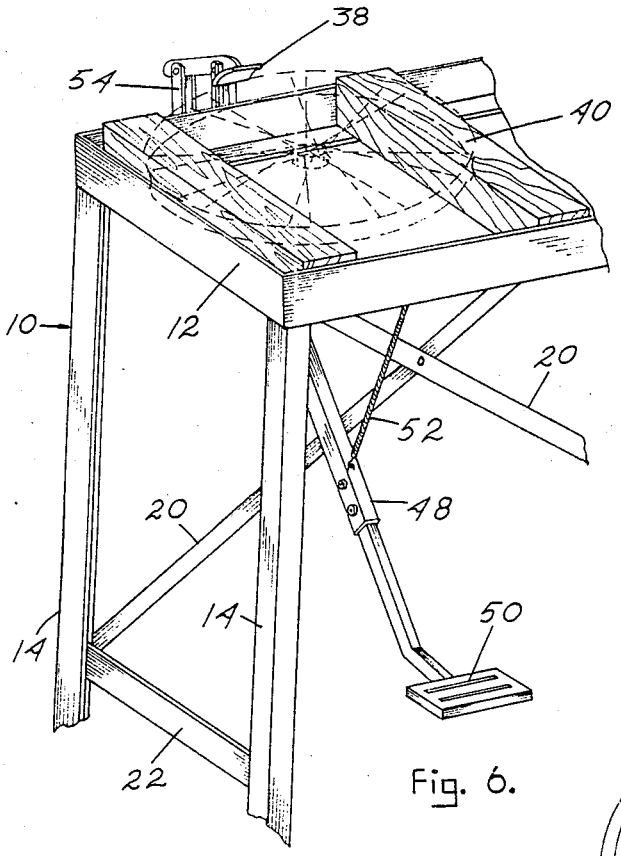
FIG. 6 is a partial perspective view of the stand at the FIG. 5 end showing the foot lever mechanics with a bicycle wheel illustrated by dotted lines in the rim clamp.
Figure 7:
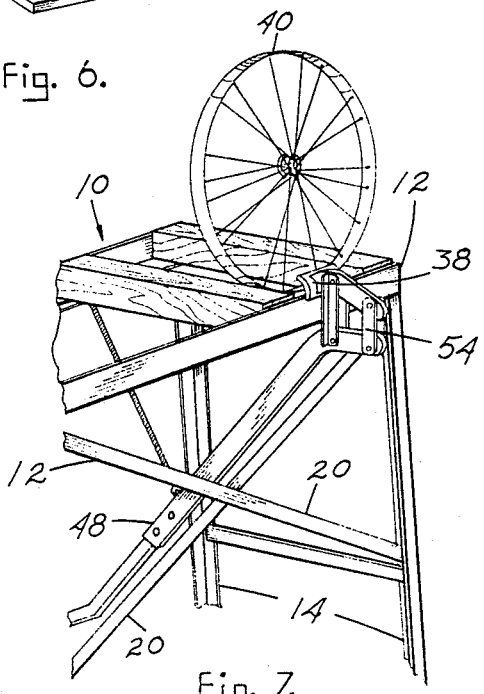
FIG. 7 is a reversed view of FIG. 6 showing pressure rim straighten of a bicycle wheel by the foot lever with the wheel being in a near vertical position.

An embodiment of the invention without pedestal 16 is illustrated in FIG. 5. Adjustable foot lever 48 is suspended below stand 10 and rim bender 38 is pressed down on a horizontally positioned wheel 40. Positioning links 54 maintain rim bender properly positioned so pressure can be applied and released at foot pedal 50. Foot pedal return spring 52 lifts rim bender 38 from wheel 40 when pressure is removed from foot pedal 50. An end section of stand 10 is shown in a perspective view in FIG. 6. Wheel 40 is laid flat on two supporting wood pieces and rim bender 38 is pressured against the rim of wheel 40 by pressing down on foot pedal 50 which activates adjustable foot lever 48. In FIG. 7, wheel 40 is shown in a vertical position illustrating the versatility of rim straightening with this device.

Figure 11:
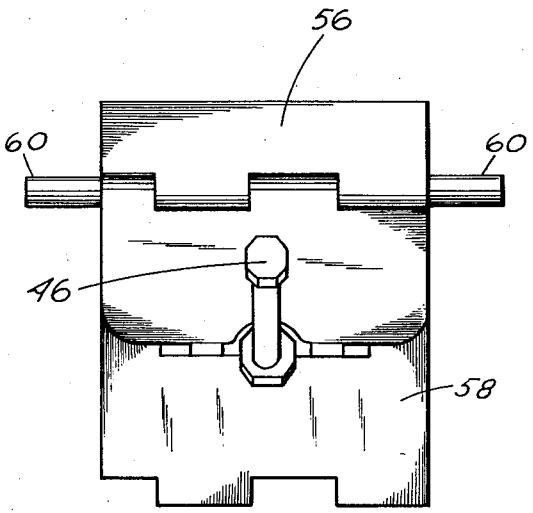
FIG. 11 is an enlarged view of the vertical gauge screw from the top illustrating the hinging of the vertical gauge screw support.
Figure 10:
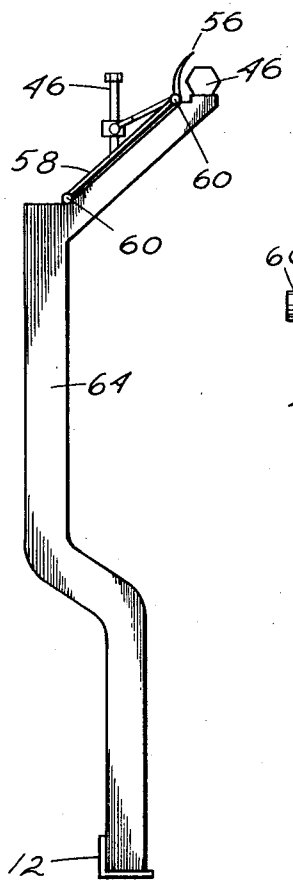
FIG. 10 is a side view of FIG. 9.
Figure 9:
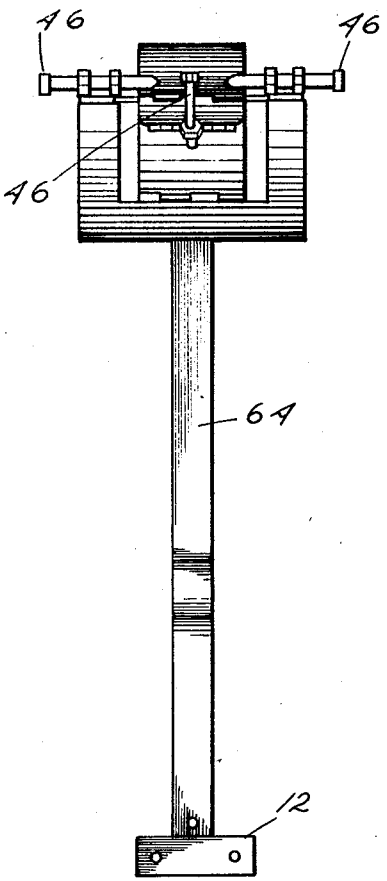
FIG. 9 illustrates the vertical rim straightening gauge fixtures in a U-shaped head with a support bracket attached.
Figure 14:
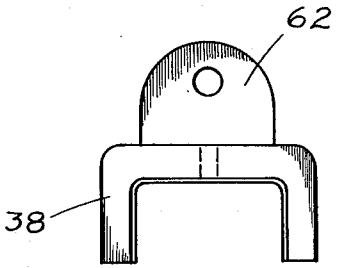
FIG. 14 is a side view of the foot lever rim clamp attachment hinge which fits the upward end of the foot lever support structure.
Figure 13:
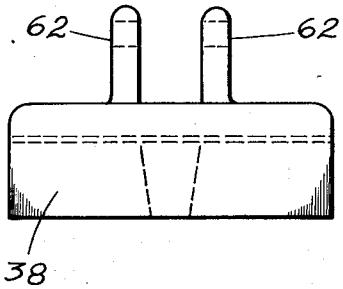
FIG. 13 is a top plan view of the pedal pad support for the foot lever.

FIG. 8 shows stand 10 in an embodiment where one-piece wheel holder 64 replaces pedestal 16 as the upright support for a bicycle wheel 40. Wheel alignment gauge 28 is vertical and to the rear of one-piece wheel holder 64. A spoke holder 36 is added above table top box frame 12 as a horizontal support member. At an end opposite one-piece wheel holder 64, a wheel vise 34 is attached, and a fastener 33 for supporting a cluster remover vise is affixed to the end of table top box frame 12 just below wheel vise 34. Front braces 24 are added to stand 10 and one angled back brace 20 and one horizontal back brace 20 supports the back side of stand 10. The positioning of adjustable footlever 48 with foot pedal 50 downward at the front and rim bender 38 upward just over the top of table top box frame 12 is illustrated. The length of adjustable foot lever 48 can be changed by repositioning bolt holes and retightening bolts in holes drilled between the upper section of adjustable footlever 48 and the extension attached to foot pedal 50. Legs 14 angle somewhat outward from table top box frame 12 to give support to stand 10. In FIG. 9, the single piece wheel holder 64 is illustrated in a frontal view. The base attaches to table top box frame 12 as shown and adjustable rim aligners 46 are positioned upwardly. In a side view at FIG. 10, the mechanics of the adjustable rim aligners 46 are illustrated. The side gauges are affixed stationary horizontal while vertical adjustable rim aligner 46 is attached to a lower hinged plate 58 as a first member and to a second upper hinged plate 56. Hinge rod 60 retains the plates. In FIG. 11, a top plan view is shown of lower hinged plate 58 and upper hinged plate 56 with adjustable rim aligner 46 in a near vertical position.

Figure 12:
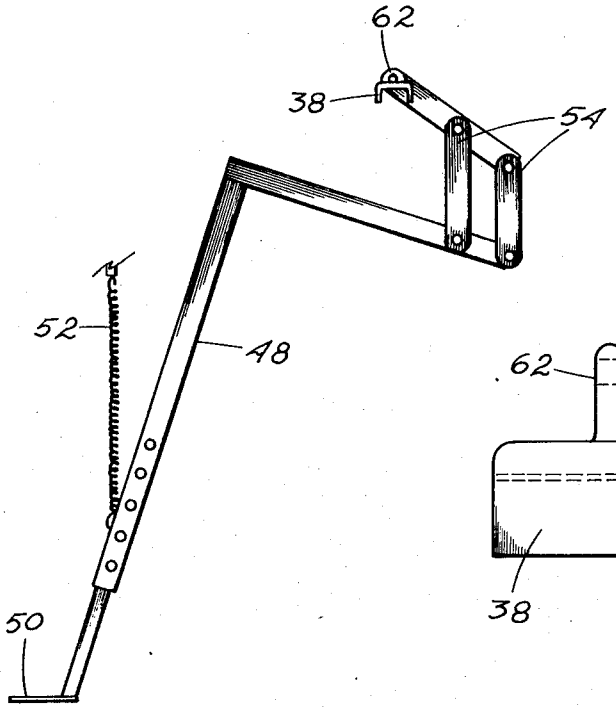
FIG. 12 is a side view of the detached foot levering clamp structure showing the opposite side from the side pictured in the FIG. 5 view.

FIG. 12 shows additional details of adjustable foot lever 48. Adjustment holes and the extended section supporting foot pedal 50 is shown downwardly. Foot pedal return spring 52 attaches at the front of adjustable foot lever 48 and upwarldy to any member of stand 10 (not shown). Rim bender 38 is attached hingedly upwardly to an extended member of adjustable foot lever 48 by rim bender hanger 62 and retained properly positioned by positioning links 54.

The versatility of this invention can be seen by the fact that stand 10 becomes a multiple job station combined in a single device. Bicycle rims may be straightened as needed in both horizontal and vertical positions. The necessary vises and clamps are immediately available for both straightening rims and checking the results. Spoke replacement can be accomplished at the same time using the same equipment.

Although I have described embodiments of my invention with considerable details, it is to be understood that the descriptions and drawings are illustrative of the invention only and that changes in the design and structure may be practiced so long as any changes made remain within the intended scope of the appended claims.

What is claimed is:

1. A bicycle wheel rim straightener stand comprising, in combination:

a stand;

said stand having a substantially rectangular horizontally oriented table top box frame with four legs one at each corner, said legs extending downwardly and outwardly therefrom;

means for rotatably supporting a bicycle wheel positioned vertically relative to said stand on top of said table top box frame at one smaller end thereof;

means for adjustably aligning and gauging said rim of said bicycle wheel rotatably supported with said bicycle wheel positioned vertically;

a levering means for pressurizing a rim bender to straighten said rim of said bicycle wheel with said bicycle wheel horizontally positioned on top of said table top box frame;

a spoke holder frame member affixed above and paralleling said table top box frame.

2. The stand as defined in claim 1 wherein said means for rotatably supporting a bicycle wheel positioned vertically on top of said table top box frame at one smaller end thereof includes a raised pedestal having attachments for supporting said bicycle wheel by a removable sprocket.

3. The stand as defined in claim 1 wherein said means for rotatably supporting a bicycle wheel positioned vertically on top of said table top box frame at one smaller end thereof includes a raised two-piece wheel holder having attachments for supporting said bicycle wheel by a removable sprocket.

4. The stand as defined in claim 1 wherein said means for adjustably aligning and gauging a rim of said bicycle wheel rotatably supported positioned vertically includes at lease three adjustable rim aligners with two in opposition on either side of said rim of sai bicycle wheel and one facing centrally towards on outer surface of said bicycle wheel rim.

5. The stand as defined in claim 1 wherein said levering means for pressurizing a rim bender to straighten said rim of said bicycle wheel with said bicycle wheel horizontally positioned on top of sait table top box frame includes a foot pedal accessible in open space below said table top box frame arranged by said levering to pressurize a rim bender against said bicycle wheel horizontally positioned.

* * * * *